US005088431A

United States Patent [19]

Pizzey

[11] Patent Number: 5,088,431

[45] Date of Patent: Feb. 18, 1992

[54] SAILING VESSELS

[76] Inventor: John K. Pizzey, 72 Duro Road, Wellinton Point, Queensland, Australia, 4160

[21] Appl. No.: 528,831

[22] Filed: Jun. 27, 1988

Related U.S. Application Data

[63] Continuation-in-part of Ser. No. 18,901, filed as PCT/AU86/00159, Jun. 3, 1986, abandoned.

[30] Foreign Application Priority Data

Jun. 3, 1985 [AU] Australia ..... PH0868

[51] Int. Cl.[5] ..... B63H 9/04

[52] U.S. Cl. ..... 114/39.1; 114/102; 114/163

[58] Field of Search ..... 114/39.1, 61, 163, 102

[56] References Cited

U.S. PATENT DOCUMENTS

| | | | |
|---|---|---|---|
| 2,756,711 | 7/1956 | Simpson | 114/102 X |
| 2,893,339 | 7/1959 | Ram | 114/39.1 |
| 2,944,505 | 7/1960 | Berge | 114/39.1 |
| 3,173,395 | 3/1965 | Laurent | 114/102 X |
| 3,223,065 | 12/1965 | Wilson, Jr. | 114/39.1 |
| 3,867,894 | 2/1975 | Vicard | 114/102 |
| 4,584,957 | 4/1986 | Belvedere | 114/39.1 |

*Primary Examiner*—Sherman Basinger
*Attorney, Agent, or Firm*—Nixon & Vanderhye

[57] ABSTRACT

Proa sailing vessel including a pair of spaced hulls comprising a windward and a leeward hull, a crossbeam assembly interconnecting the hulls and a fixed mast assembly with its lower end supported on the crossbeam intermediate the hulls and being inclined athwartship so that its upper end is disposed substantially vertically above the windward hull. The mast assembly is supported by a rigging arrangement which includes a standing stay extending between the upper end portion of the mast assembly and the windward side of the proa and a pair of pivot stays extending from an elevated pivotable mounting on the upper end portion of the mast assembly to respective opposite ends of a first boom connected through a lower pivotable mounting disposed intermediate the respective opposite ends to the leeward side of the proa. In this way, the pivot stays may be pivoted with the boom between respective opposing longitudinal positions at opposite sides of a pivot axis extending between the elevated and lower pivotable mountings whereby one of the pivot stays constitutes a forestay along which the sail may be hoisted.

8 Claims, 7 Drawing Sheets

SAILING VESSELS

CROSS-REFERENCE TO RELATED APPLICATION

The present application is a continuation-in-part application of application Ser. No. 18,901, filed as PCT/AU86/00159, Jun. 3, 1986, and now abandoned.

This invention relates to improvements to multihull sailing boats.

BACKGROUND OF THE INVENTION

For many years attempts have been made to improve the sailing efficiency of yachts in order to increase their sailing speed while retaining safety and ease of handling. Catamarans have become extremely popular due to their stability and high speed sailing ability. This high speed potential is achieved by the use of narrow hulls which do not have a displacement speed limitation and by the relatively high power to weight ratio which may be achieved because of the inherent stability of the catamaran configuration.

The power to drive such vessels is derived from sails set fore and aft. It has been realized for many years that the force produced by the sails includes a driving components which moves the boat forward and a lateral component which normally causes the boat to heel and move sideways and that the efficiency of a yacht may be increased by inclining the sails so as to utilize the lateral component for producing lift and for reducing the sideways component.

To date however the only commercially successful yachts to utilize sails inclined to produce lift have been sailboards. Inclined sails have also been used on high speed craft such as proas which are reversible twin hulled boats which maintain their respective hulls always in a selected windward/leeward configuration. These arrangements have been used on specialized racing craft only and have not been suitable for general purpose yachts due to practical disadvantages.

Conventional proas have a main or heavy hull and an outrigger or light hull whereby the centre of gravity of the yacht is offset towards either the windward or leeward hull of the craft. In the first mentioned configuration the relatively heavy windward hull gives increases stability provided the vessel is maintained with its heavy hull to windward. If the hull is positioned to windward the ability of the vessel to stand up to the sail force is greatly reduced making a capsize probable. In the second mentioned type of proas the overturning moment created by the sail force is resisted by varying the weight of the windward hull, generally either by placing crew on the windward outrigger or by ballasting the latter with water.

SUMMARY OF THE INVENTION

This invention aims to provide sailing vessels which may utilize either a light hull or heavy hull to windward and which will be reliable and efficient for its particular purpose of use. Other objects and advantages of this invention will hereinafter become apparent.

With the foregoing and other objects in view, this invention in one aspect resides broadly in a proa sailing vessel comprising:

a pair of spaced hulls comprising a windward hull and a leeward hull each having underwater sections which are substantially symmetrical about a transverse centreline;

a cross beam assembly interconnecting said hulls;

a mast assembly having an upper end portion which is carried above and within a vertical projection of said windward hull;

rigging means for supporting said mast assembly;

elevated sail holding means on said upper end portion of said mast assembly for holding the upper portion of a sail;

lower sail holding means on the leeward side portion of said proa for holding the lower portion of a sail, and sail hoisting means for hoisting a sail to extend between said elevated and lower sail holding means in such manner that the operative leading and trailing edges of said sail may be altered from one end of the vessel to the other so as to maintain said hulls in their windward and leeward placements.

In another aspect, there is provided a proa sailing vessel comprising:

a pair of spaced hulls comprising a windward hull and a leeward hull;

a cross beam assembly interconnecting the hulls;

a fixed mast assembly having its lower end supported on the cross beam intermediate the hulls and being inclined athwartship whereby its upper end is disposed substantially vertically above the windward hull;

rigging means for supporting the mast assembly and including a standing stay extending between the upper end portion of the mast assembly and the windward side of the proa and a pair of pivot stays extending from an elevated pivotable mounting on the upper end portion of the mast assembly to respective opposite ends of a first boom connected through a lower pivotable mounting disposed intermediate the respective opposite ends to the leeward side of the proa, whereby the pivot stays may be pivoted with the boom between respective opposite longitudinal positions at opposite sides of a pivot axis extending between the elevated and lower pivotable mountings and wherein one of the pivot stays constitutes a forestay along which a sail may be hoisted.

In a preferred form, the sailing vessel is provided with a pair of booms each suspended from respective pairs of pivot stays supported by respective pivot mounting and each connected by a respective one of a pair of longitudinal spacer lower pivot mountings to the leeward sides portion. Preferably, the forestay when disposed in either of the opposing longitudinal positions is inclined between 25 and 35 degrees from the vertical. In a further preferred feature, the sail is a soft sail and there is provided a second boom for maintaining luff and leech parts of the sail in their operative spaced relationship.

The sail assembly is preferably supported by an elevated pivotable mounted and a lower pivotable mounting whereby the sail assembly may be pivoted between respective opposing longitudinal positions at opposite sides of the pivot axis extending between the elevated and lower pivotable mountings, the mast assembly being support by the pivotable mounting. According to another preferred feature, the sail assembly includes a lower beam secured to the mast assembly and extending forwardly and rearwardly therefrom, a main sail supported by the mast assembly and the rearward extension of the beam, and a foresail supported by the mast assembly and the forward extension of the beam.

The sail assembly may be a wing sail but preferably the sail assembly includes a soft sail supported on a stay assembly and/or mast or the like which extends from a lower attachment position on or adjacent said leeward hull to an elevated attachment position on a mast above the windward hull. The sail assembly may include a stay which may be constituted by or incorporated in the leading edge of a sail but preferably it is separate from the sail whereby the latter may be raised and lowered along or furled about the stay. Of course more than one mast may be used and more than one sail may be set from each mast.

The sail assembly may be adjustably inclined and preferably between twenty and forty-five degrees to the vertical. Of course the masthead or the mast or sail base could be outside the extremities of the vessel if desired. Suitably the sail arrangement is such that the sail may pivot about an inclined pivot axis to an opposed position to cause the vessel to pivot towards its new heading so that as the sail is sheeted in, the vessel will move off in the desired direction.

The line or axis interconnecting the sail attachment points preferably lies between the front and rear edges of the sail. Suitably this axis lies int he front one third of the sail such that latter in use is substantially balanced. For this purpose, the mast may be secured to a base beam which projects forwardly therefrom to support a headstay or sail and rearwardly to support the clew of the sail set from the mast and back stays for tensioning the luff or headstay. In this manner sail tension stresses are accommodated internally within the mast, base beam and backstays. In such assembly the upper end of the mast is supported by prop means which connects universally to the front of the mast above the forestay connection. The prop means may be stayed to enable controlled fore and aft movement of the upper end of the mast and it may be extendible or otherwise mounted to enable the inclination of the mast to be varied.

The base of the sail may be supported outside the extremities of a vertical projection of the water plane of the leeward hull. The centre of lift may be disposed to leeward of the lateral position of the vessels C.G. so that the lifting force provides a stabilizing moment which opposes the overturning moment caused by the horizontal component of the sail force. The mast may be inclined in the athwart plane whereby the staying angles for lateral stays to both sides of the vessel are sufficiently large to eliminate the need for mast/stay spreaders. The stay extending from the outermost side of the vessel to the elevated attachment point may be substantially vertical. Of course a conventionally stayed mast system could be used and the uppermost attachment point could be inboard of the outer extremities of the vessel.

In one form there is provided a central stay or member for supporting a central sail and longitudinally spaced stays or members for supporting respective headsails at opposite ends of the vessel. Either headsail may be employed as required and the central sail may pivot about the central stay for changing direction. Alternatively a single headsail could be swapped from end to end to suit the direction of travel of the vessel. For this purpose the sail could be in the form of a triangular sail or a spinnaker like sail set flying and adapted to be moved towards either end, such as in a so called "Taylor Rig".

Preferably however the sail assembly includes one or more sails each of which in use is set between upper and lower attachment points or pivots about which the sail may pivot for reversal. Such arrangement has the advantage that movement of the sail about its pivot axis to an opposed position causes the vessel to pivot towards its new heading so that as the sail is sheeted in, the vessel will move off in the desired direction. The line or axis interconnecting the sail attachment points preferably lies between the front and rear edges of the sail. Suitably this axis lies in the front one third of the sail such that the latter in use is substantially balanced.

A storm sail may be arranged so that athwartship component of the sail force vector acts through or adjacent the centre of gravity of the vessel so as to substantially reduce or eliminate the transverse overturning moment which may be created thereby. Of course the sail force may b e arranged to act through a point at either side of the centre of gravity of the vessel. This may be achieved by setting a sail from a lower point on a fixed mast rig or by increasing the inclination of a reefed sail on an adjustable mast rig.

This invention in a further aspect includes a steering system for a vessel including longitudinally spaced rudders each being freely rotatable about their steering axis so as to operatively align with the water flow there past and having control means such that they may be used to steer and/or trim the vessel. The operative leading rudder may be locked in a position in which it has a suitable angle of attack with the water flow to counteract imbalance caused by the sails or asymmetrical hulls and the trailing rudder may be used to steer the vessel or vice versa. Preferably, each rudder is mounted for selected pivotal movement about a longitudinal axis whereby each rudder may be pivoted to a selected inclined position. Both rudders may be used to steer the vessel and for this purpose they may be controlled by respective tillers or wheels supported adjacent one another. Alternatively, both rudders may be controlled for simultaneous actuation by a common steering wheel.

In a proa the rudders may be in either hull and a single rudder could be used, acting as a trailing rudder during motion in one direction and a leading rudder in the opposite direction of motion. Alternatively the rudder or rudders could be in the form of an adjustable trim board adapted to be raised or lowered or pivoted to achieve the desired balance on any selected heading.

Preferably in larger proas having accommodation, the windward hull is relatively large to provide the accommodation and the leeward hull is in the form of a stabilizing float or outrigger.

If desired the balancing forces created by the asymmetrical hull could be provided by suitable foils which could be asymmetrical if desired. The main hull could be in the form of a displacement or planing hull and the foils could be arranged to lift the outrigger from the water at a selected speed. The foils could be used to steer the vessel.

BRIEF DESCRIPTION OF THE DRAWINGS

In order that this invention may e more readily understood and put into practical effect, reference will now be made to a preferred embodiment of the invention illustrated in the accompanying drawings, wherein.

DETAILED DESCRIPTION OF THE INVENTION

Figure 1:
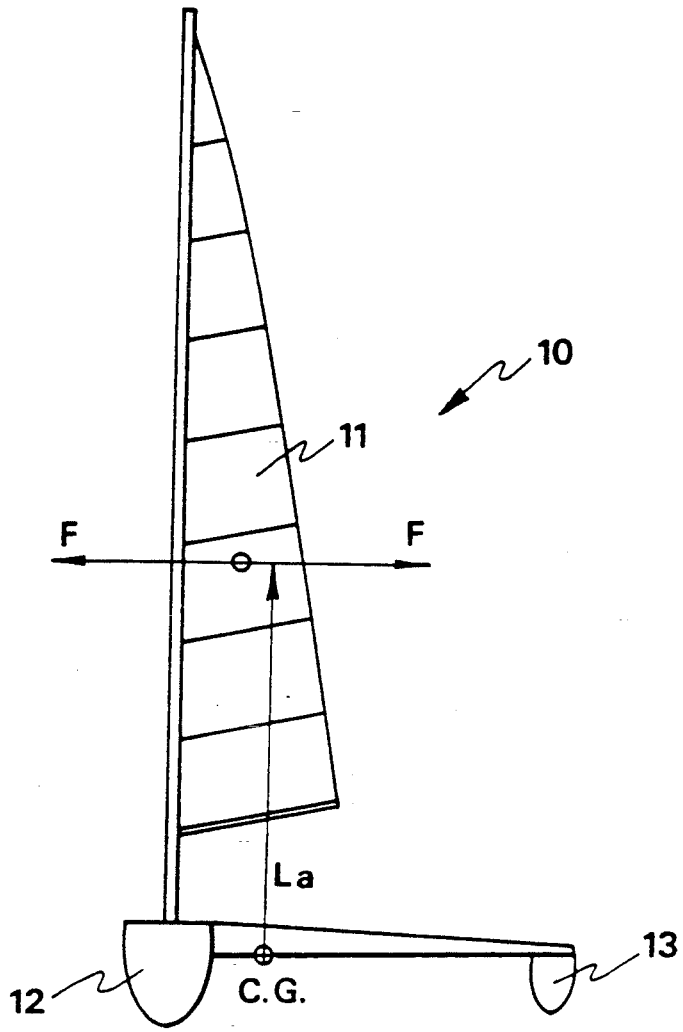
Figure 1. (PRIOR ART)
FIG. 1 is a diagrammatic end view of a conventional proa.

Referring to FIG. 1 it will be seen that in a conventional proa 10 the sideways force from the sail assembly may be inclined at between twenty to forth degrees to the vertical of the vessel. Thus an overturning moment equal to F.La is produced in use. When acting clockwise this can be counterbalanced by the heavy main hull 12. When acting anti-clockwise this can be counterbalanced only by the leverage exerted by the relatively light float 13. Since the main hull 12 may be four or more times the weight of the float 13 it will be seen that it is important that the main hull 12 is maintained to windward for maximum stability.

Figure 2:
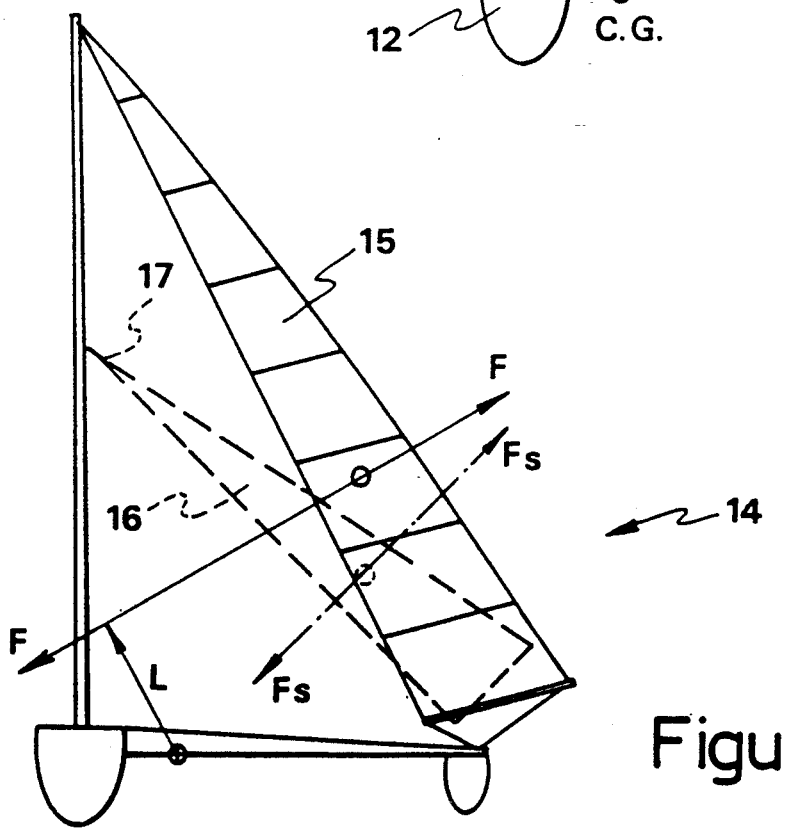
FIG. 2 is a diagrammatic end view of a proa made in accordance with one aspect of this invention.

In the proa 14 illustrated in FIG. 2 the same force F from the sails 15 acts in a direction inclined to the horizontal so that the overturning moment created thereby is reduced by the smaller leverage distance L from the centre of gravity. The ratio of L:La in this instance, for similar sails is approximately 2.5:1. Since the stability provided by the hulls is unchanged it will be seen that the force F necessary to capsize the proa 14 in either direction will be 2.5 times that necessary to capsize the conventional proa 10. This is particularly significant for a capsizing moment in the anti-clockwise direction whereby the risk of capsizing the proa 14 in the anti-clockwise direction is greatly reduced. In addition "anti-clockwise" wind forces have a downward component which adds to the stability of the vessel.

If high winds are encountered a storm sail (shown in dotted outline at 16) may be set on a lower stay 17, or free if desired, such that the sail inclination is increased whereby its force Fs acts through the centre of gravity thereby producing no overturning moment due to wind pressure. If desired the storm sail 16 could be set with the outer sails which could be lowered during periods of strong winds or when sailing with the vessel unattended.

Figure 3:
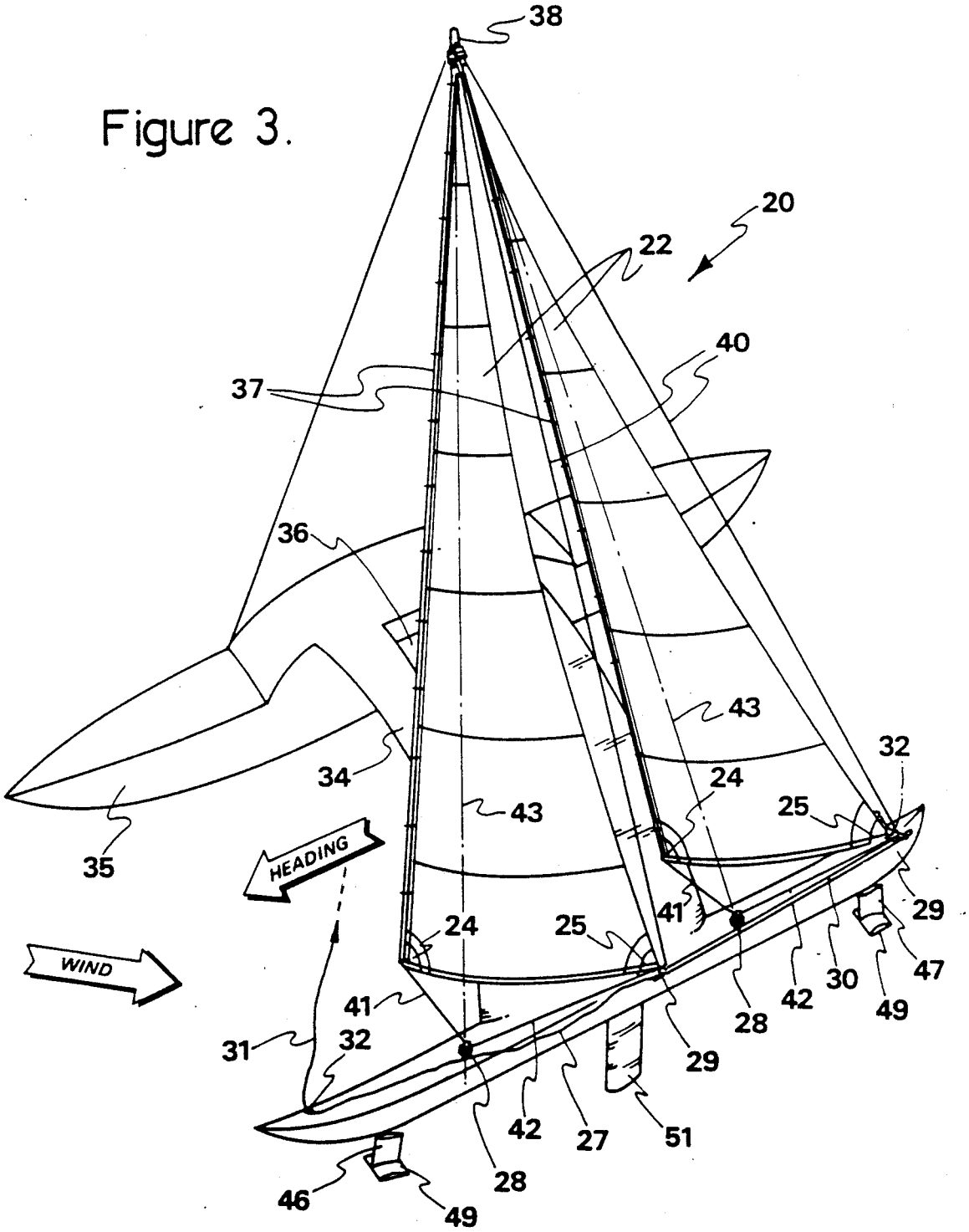
FIG. 3 is a perspective view of a cruising proa according to this invention.
Figure 4:
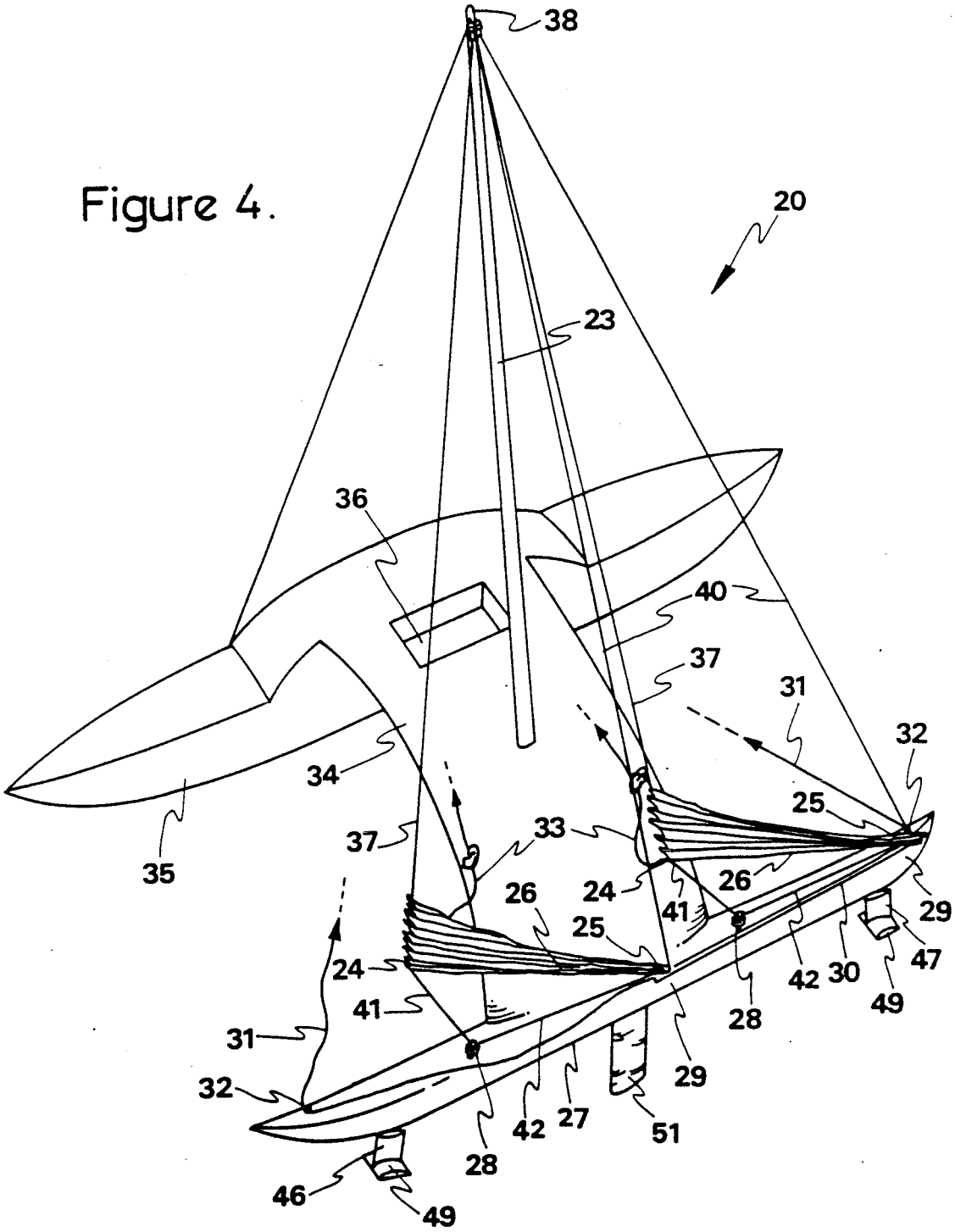
FIG. 4 is a perspective view of the proa illustrated in FIG. 3, and illustrating basic rigging details.

In the vessel 20 illustrated in FIGS. 3 and 4, the working sails are inclined at thirty degrees to the vertical and comprise a pair of identical balanced triangular sails 22 each having their upper ends supported by masthead pivot mounting 38 on the mast 23 and their respective lower corners 24 and 25 supported adjustably in spaced apart relationship by a boom or batten 26 which is anchored pivotally to the outrigger 27 by pivot mountings 28 disposed at positions approximately one third back from the leading edge of each sail 22.

The trailing ends 29 of the booms 26 are interconnected by a strut 30 and control ropes 31 lead from the strut 30 about blocks 32 at the respective opposite ends of the outrigger 27 to the cockpit 36 so that the sails may be trimmed and rotated through 180 degrees to enable the vessel 20 to sail in opposite directions of travel. For this purpose the aft line 31 is adjusted to pivot the sails to their operative positions.

Trim lines 33 may be connected between the leading ends of the booms 26 and the bridgedeck 34 (which connects the outrigger 27 to the main hull 35) to prevent over rotation of the sails beyond their close-hauled positions. These trim lines 33 may be adjusted from the cockpit 36. The luff of each sail 22 is banked to its respective forestay 37 both of which extend from their masthead pivot mounting 38 to the leading end 39 of the boom 26. In use, the leech extends freely from the boom 26 to the masthead pivot mounting 38. However, in use the leech will at all times be tensioned so that the sail is maintained in a selected airfoil shape irrespective of its pivotal location. The sails 22 may be raised, lowered and stowed in conventional manner as shown in FIG. 4. The sails may be set on roller furling gear if desired. The lower part of the sails 22 may extend downwardly from the boom 26 to the pivot mountings 28 on the outrigger. Such sails may be set loose from the boom with the leading sail set outside the boom and the trailing sail set inside the boom. This will have the effect of producing a leading sail which will be fuller than the trailing sail.

As shown in FIG. 4, each boom 265 is permanently suspended from the masthead pivot mounting 38 by the forestay 37 and a rear stay 40. In this embodiment, the bridle has a short leading bar 41 and a longer trailing bar 42 whereby the boom may pivot about the respective axis 43 passing from the masthead pivot mount 28 to the outrigger pivot mount 28. Each axis 43 is disposed intermediate the forestay and back stay and the luff and leech of the sails 22 and in the leading part of each sail 22. The booms 26 are interconnected by the strut 30 for simultaneous pivotal movement. The strut 30 may be length adjustable if desired to enable the relative settings of the sails to be varied. The trim lines 33 may also be used for this purpose.

the control ropes 31 may pass to a common winch rotatable in either direction to pivot the sails in a corresponding direction. This winch may include a wheel activated rope drum which may be supported co-axially with a vessel steering wheel for ease of control of the vessel 8. Alternatively the rope 31 may pass to separate winches. The clew 25 of one of the sails 22 may be attached to its boom 26 by a trip mechanism adapted to release when the sail is caught aback. In such situations release of one sail will halve the sail force. Wind force on the other sail will force the vessel back around to its correct alignment.

Figure 5:
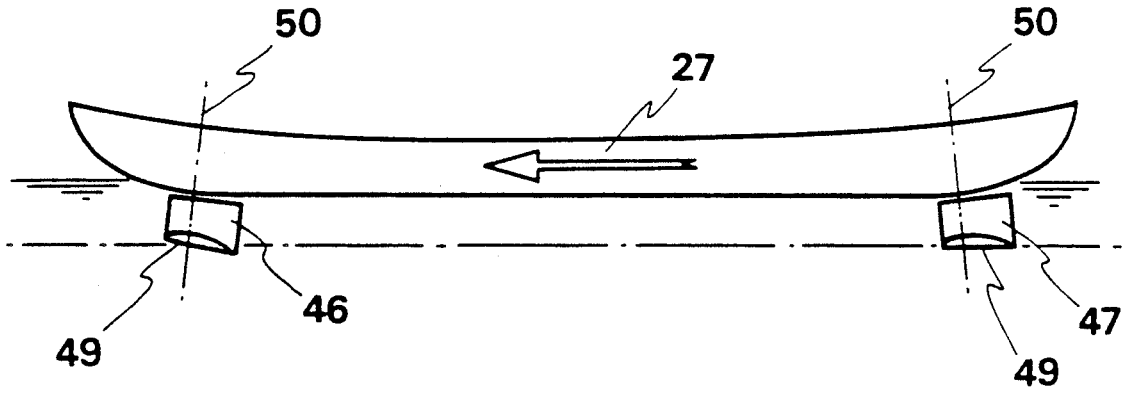
FIG. 5 illustrates the rudder configuration.

In the embodiment illustrated there are provided two rudders 46 and 47 disposed one at each end of the outrigger 27. Each rudder is a freely rotatable balanced rudder which rotates through 180 degrees when the vessel 20 reverses. These rudders 46 and 47 may be steered from a common wheel or separate wheels. Each is provided with a foil 49 at its base. The rudders 46 and 47 are pivotable about inclined axes 50 as illustrated in FIG. 5, and the blade of each foil 49 is inclined to its axis of rotation so that the angle of attack of the leading rudder is always greater than the trailing rudder. In use this lifts the bow of the outrigger 27 and stabilizes the stern. The stern rudder remains submerged from steering. The foil 49 also is of shallow form so that it will slide sideways through the water should the vessel be caught in strong winds with the outrigger 27 to windward. In such event, if the vessel begins to overturn, the sail will quickly approach a horizontal attitude and spill the wind therefrom. A lee-board or daggerboard 51 or the like may be positioned centrally on the outrigger 27.

In lieu of the two sails illustrated a single balanced sail of the type described above could be used. This could be an asymmetrical sail which would be rotated about a central pivot point on the outrigger for reversing or it could be a symmetrical sail having a boom mounted track connected by a traveller car to a central position of the float 14 whereby the pivot axis of the sail could be varied as desired, suitably by tensioning respective sheets connected to the lower corners of the said at opposite ends of the boom.

Figure 6:
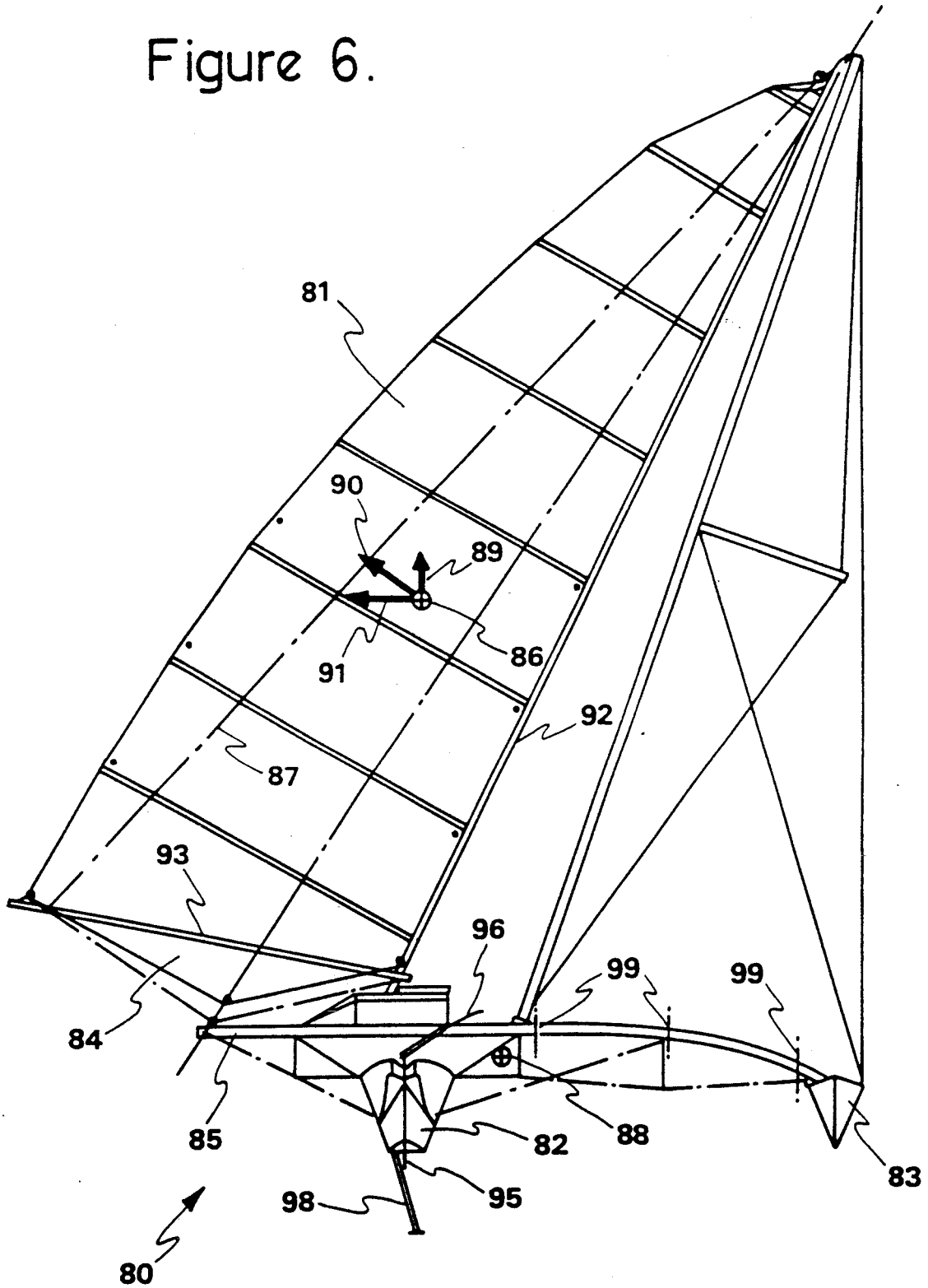
FIGS. 6 and 7 illustrate a trailerable embodiment of the invention.
Figure 7:
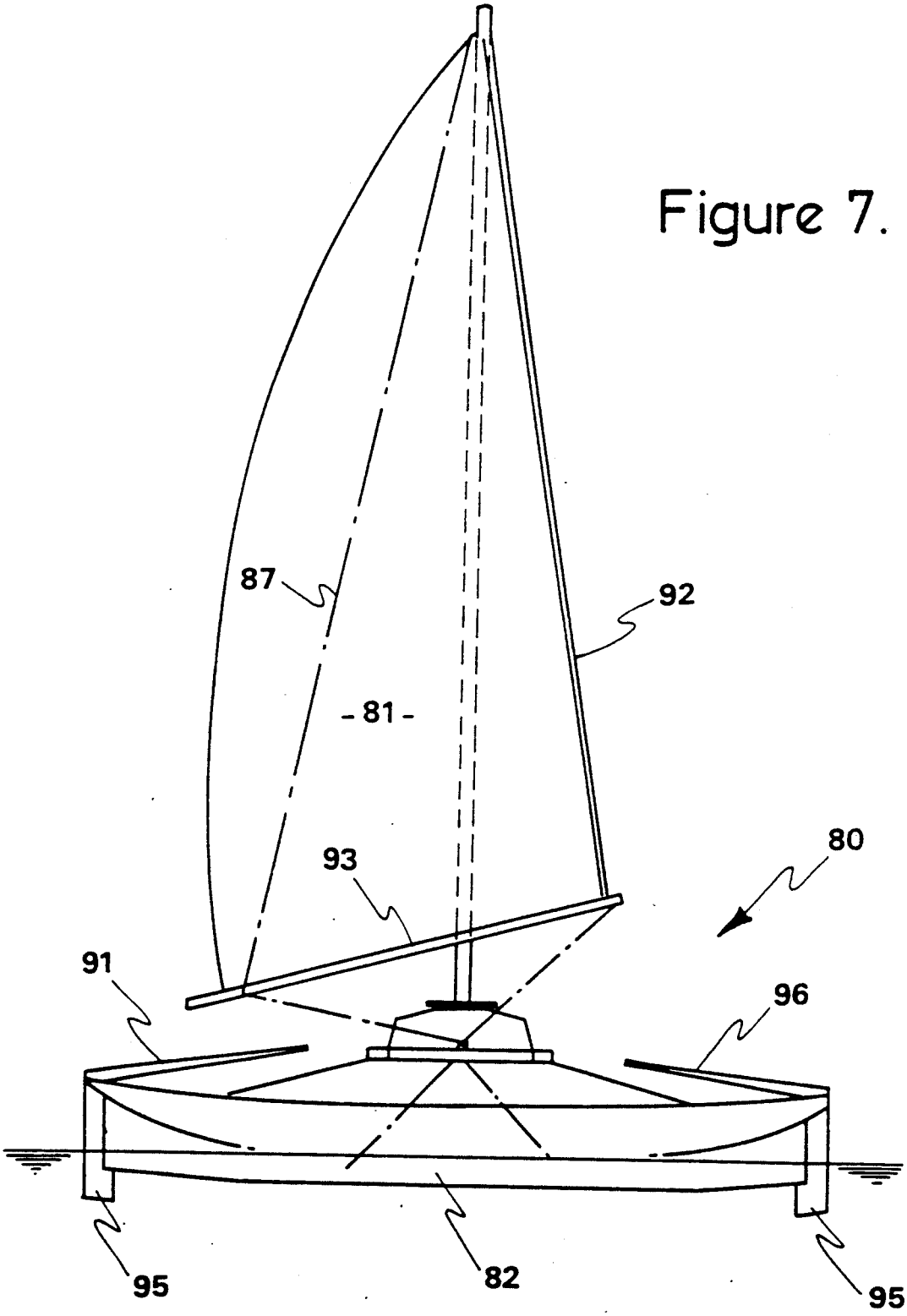

The trailerable vessel 80 illustrated in FIG. 6 and 7, utilizes a single balanced sail 81 of the type described above which in use is inclined to windward from the crew supporting hull 82 whereby the small stabilizing hull 83 is maintained to windward. The leeward hull provides sufficient buoyancy to support the vessel when caught aback or just sufficient so that it will be initially depressed beneath the water until the wind is spilled from the sail whereupon it will resurface. This will prevent a capsize. The windward hull 83 can be provided with water ballast tanks if desired which may be filled to suit the prevailing conditions.

The base 84 of the sail 81 is supported on a side extension 85 of the hull 82 so that its centre of lift point 86 is to leeward of the vessel's centre of gravity C.G. 88 whereby the moment resulting from the vertical component 89 of the sail force 90 opposes the moment resulting from the horizontal component 91.

The sail 81 is a battened sail and for this purpose the leading stay incorporates an aerodynamic foil 92 with a boltrope groove or the like for retaining the sail luff. The boom 93 is a wishbone boom with the rear thereof supported by a pair of spaced stays 87 at either side of the sail. The latter may be formed with a hollow luff to maintain correct sail shape when set form a sagging stay and the rear stays may be adjustable to selectively vary the sag in the forestay and luff foil or spar. The latter is also selectively and adjustably rotatable about its axis for optimum sail/foil shape. Alternatively, the foil may be rigged with diamond stays or the like in known manner which may be adjustable so that a selected forward bow or straightness may be maintained in the foil or spar.

The rudders 95 are supported at each end of the crew supporting hull 82 and are connected to separate tillers 96 which may be operated independently and locked so that the rear rudder can be used for steering and the front rudder trimmed, if desired, or locked in a straight ahead position. A central centreboard 98 is also provided. The cross beams are hinged at 99 so that they may break at the hinges to enable the hull 83 to move inwards to a position beside the hull 82 for trailing purposes. This arrangement enable all steering controls and the centreboard 98 to be positioned on the main hull 82 for convenient folding.

Figure 8:
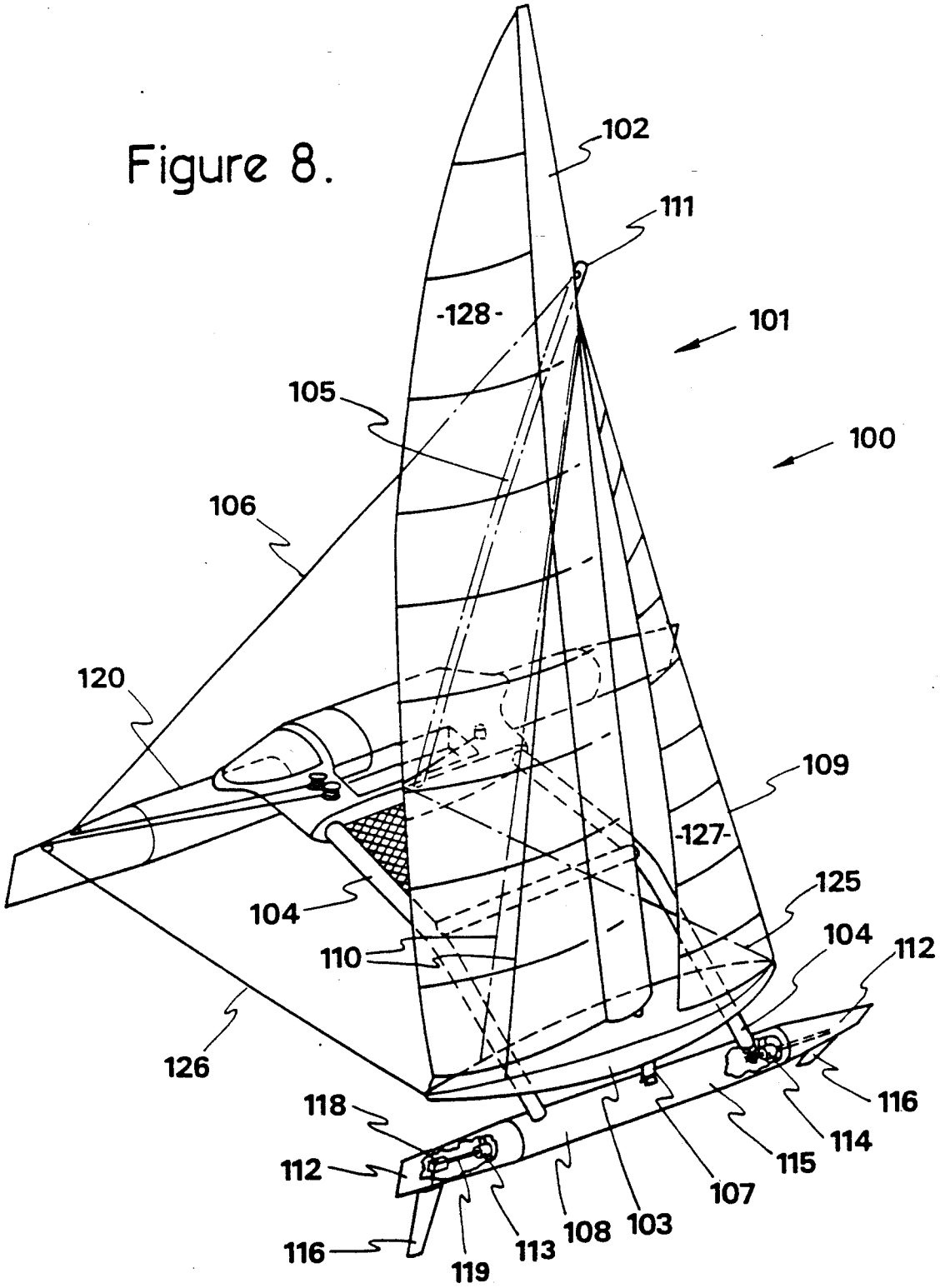
FIG. 8 illustrates another embodiment of the invention.

The vessel 100 illustrated in FIG. 8 utilises an internally stressed sail assembly 101 whereby stay tensions are reacted against the must 102 and the base beam 103 and thus do not induce high bending moments in the cross beams 104. A relatively light vessel can therefore be given a relatively wide beam and a relatively tail sail assembly 101. The mast 102 is supported by rigging which includes a prop 105 stayed by running stays 106 to enable to prop 105 and the mast 102 to be pivoted fore and aft.

The mast 102 is supported rotatably on the base beam 103 which is connected universally at 107 to the float 108. A forestay 109 and opposed side stays 110 secure the mast to the base beam 103. The prop 105 connects to the front of the mast above the stays 109 and 110 by a universal mounting 111. The prop 105 is a telescopic strut which may be selectively extended or retracted to vary the inclination of the sails and thus maintain them at maximum driving inclination.

The float 108 is tubular and the end sections 112 are supported on central tubular stub axles 113 which pass through bearing tubes 114 fixed to the float 108 so that they may be rotated about a longitudinal axis 115 to pivot the end sections 112 and thus the steerable foils 116 about the axis 115, as required. The rudders 116 are steered through right angle drive gearboxes 118 by steering controls 119 which pass through the hollow stub axles 113 and the cross beams 104 to the main hull 120. Control cables also pass through the cross arms to the cockpit to enable the inclination of the rudders and thus there projected vertical area to be selectively varied.

In use, the centre of lateral resistance can be varied fore and aft by varying the relative inclinations of the rudders. For example, the leading rudder can be inclined at 45 degrees while the trailing rudder remains vertical. The latter can be used for steering and the leading rudder trimmed to lift the float 108 to counteract sail forces which tend to depress the leading end of the vessel 100. The sail assembly 101 can also be trimmed fore and aft so that both leading and trailing rudders provide lift to windward. In this embodiment, the said assembly with the mast beam is pivoted about the axis extending between the mountings 107 and 111 to position the said assembly 101 for use in either direction and to spin the vessel from one windward heading to the other. Front and rear control lines 125 and 126 are provided for this purpose. The sails 127 and 128 may be adjusted in conventional manner.

A solid wing can also provide such benefits. Preferably the latter is pivoted from a base point aft of its leading edge so that the sail will be partially balanced to reduce control forces. Furthermore the sail assemblies described above can be pivoted so as to be overbalanced if desired.

Other vessels provided with a centrally disposed mast could also utilize the sails of this invention. For example on a catamaran a storm sail could be set between a float and a suitable position on the central mast. Alternatively the vessel could be provided with respective sets of sails set on inclined stays or spars at each side for use on respective tacks. Furthermore the balance sail assemblies described herein could be used advantageously on a conventional proa or other sailing vessel with upright sails by utilizing a bipod mast assembly with the balanced sail set between the legs of the mast assembly and such configurations are embraced by this invention.

Of course it will be realised that the above has been given only by way of illustrative examples of the present invention and that all such modifications and variations thereto as would be apparent to persons skilled in the art are deemed to fall within the broad scope and ambit of this invention as is defined in the appended claims.

I claim:

1. A proa sailing vessel comprising:

a pair of spaced hulls comprising a windward hull and a leeward hull;

a cross beam assembly interconnecting said hulls;

a fixed mast assembly having its lower end supported on said cross beam intermediate said hulls and being inclined athwartship whereby its upper end is disposed substantially vertically above said windward hull;

rigging means for supporting said mast assembly and including a standing stay extending between the upper end portion of said mast assembly and the windward side of said proa and a pair of pivot stays extending from an elevated pivotable mounting on said upper end portion of said mast assembly to respective opposite ends of a first boom connected through a lower pivotable mountings disposed intermediate said respective opposite ends to the leeward side of said proa, whereby said pivot stays may be pivoted with said boom between respective opposing longitudinal positions at opposite sides of a pivot axis extending between said elevated and lower pivotable mountings and wherein one said pivot stay constitutes a forestay along which a sail may be hoisted.

2. A proa sailing vessel according to claim 1, wherein said pivot axis is disposed closer to said forestay than to the other said pivot stay.

3. A sailing vessel according to claim 2, wherein there are provided a pair of said booms each suspended from respective said pairs of pivot stays supported by respective pivot mountings and each connected by a respective one of a pair of longitudinal spaced lower pivot mountings to said leeward side of said proa.

4. A proa sailing vessel according to claim 2, wherein said sail is a soft sail and there is provided a second boom for maintaining luff and leech parts of said sail in their operative spaced relationship.

5. A proa sailing vessel according to claim 1, wherein said forestay when disposed in either said opposing longitudinal positions is inclined at between twenty-five and thirty-five degrees from the vertical.

6. A proa sailing vessel comprising:

a pair of spaced hulls comprising a windward hull and a leeward hull each having underwater sections which are substantially symmetrical about a transverse centerline;

a crossbeam assembly interconnecting said hulls;

a mast assembly having an upper end portion which is carried above and within a vertical projection of said windward hull;

rigging means for supporting said mast assembly;

elevated sail holding means on said upper end portion of said mast assembly for holding the upper portion of a sail;

lower sail holding means on the leeward side portion of said proa for holding the lower portion of a sail;

said hoisting means for hoisting a sail to extend between said elevated and lower sail holding means in such manner that the operative leading and trailing edges of said sail may be altered from one end of the vessel to the other so as to maintain said hulls in their windward and leeward placements, and a sail assembly supported by an elevated pivotable mounting and a lower pivotable mounting whereby said sail assembly may be pivoted between respective opposing longitudinal positions at opposite sides of a pivot axis extending between said elevated and lower pivotable mountings;

wherein said mast assembly is supported by a fixed mast assembly having rigging means for supporting said mast assembly and includes a standing stay extending between the upper end portion of said mast assembly and the windward side of said proa and a pair of pivot stays extending from said elevated pivot mounting disposed on the upper end portion of said mast assembly to respective opposite ends of a boom connected through said lower pivot mounting to the leeward side of said proa, whereby said pivot stays may be pivoted with said boom between respective oppositing longitudinal positions at opposite sides of a pivot axis extending between said elevated and lower pivot mountings and wherein one said pivot stay constitutes a forestay along which a sail of said sail assembly may be hoisted.

7. A proa sailing vessel as claimed in claim 6, wherein said leeward hull is provided with a steerable rudder at each end thereof and wherein each said rudder is selectively pivotable about a longitudinal axis whereby the projected vertical area thereof may be varied.

8. A proa sailing vessel comprising:

a pair of spaced hulls comprising a windward hull and a leeward hull each having underwater sections which are substantially symmetrical about a transverse centerline;

a crossbeam assembly interconnecting said hulls;

a mast assembly having an upper end portion which is carried above and within a vertical projection of said windward hull;

rigging means for supporting said mast assembly;

elevated sail holding means on said upper end portion of said mast assembly for holding the upper portion of a sail;

lower sail holding means on the leeward side portion of said proa for holding the lower portion of a sail;

said hoisting means for hoisting a sail to extend between said elevated and lower sail holding means in such manner that the operative leading and trailing edges of said sail may be altered from one end of the vessel to the other so as to maintain said hulls in their windward and leeward placements, and a sail assembly supported by an elevated pivotable mounting and a lower pivotable mounting whereby said sail assembly may be pivoted between respective opposing longitudinal positions at opposite sides of a pivot axis extending between said elevated and lower pivotable mountings;

wherein said mast assembly is supported by said pivotable mountings and said sail assembly includes:

a lower beam secured to said mast assembly and extending forwardly and rearwardly therefrom;

a mainsail supported by said mast assembly and the rearward extension of said beam, and a foresail supported by said mast assembly and the forward extension of said beam.

* * * * *